US007494258B2

(12) United States Patent
McNaught

(10) Patent No.: US 7,494,258 B2
(45) Date of Patent: Feb. 24, 2009

(54) LIGHTING APPARATUS FOR INCORPORATION INTO WALLS, PANELS, CEILINGS, FLOORS OR SIMILAR STRUCTURES

(76) Inventor: Donald Stephen Fraser McNaught, 10 Glashieburn Avenue, Bridge of Don Aberdeen AB22 8UQ (GB)

( * ) Notice: Subject to any disclaimer, the term of this patent is extended or adjusted under 35 U.S.C. 154(b) by 281 days.

(21) Appl. No.: 10/489,886

(22) PCT Filed: Sep. 17, 2002

(86) PCT No.: PCT/GB02/04229

§ 371 (c)(1),
(2), (4) Date: Oct. 18, 2004

(87) PCT Pub. No.: WO03/025455

PCT Pub. Date: Mar. 27, 2003

(65) Prior Publication Data

US 2005/0060949 A1 Mar. 24, 2005

(30) Foreign Application Priority Data

Sep. 17, 2001 (GB) ..... 0122397.3
Jan. 15, 2002 (GB) ..... 0200839.9

(51) Int. Cl.
*F21V 5/00* (2006.01)

(52) U.S. Cl. ..... 362/554; 362/153.1; 362/153; 362/145; 362/147

(58) Field of Classification Search ..... 362/554, 362/560, 576, 581, 364, 365, 145, 147, 148, 362/153, 153.1, 511
See application file for complete search history.

(56) References Cited

U.S. PATENT DOCUMENTS

| | | | | |
|---|---|---|---|---|
| 2,257,127 | A * | 9/1941 | Roper et al. | 362/470 |
| 2,304,458 | A * | 12/1942 | Ahron | 362/356 |
| 3,800,135 | A | 3/1974 | Ramsey | |
| 4,394,714 | A * | 7/1983 | Rote | 362/576 |
| 4,912,610 | A * | 3/1990 | Dahlberg | 362/153.1 |
| 5,005,108 | A | 4/1991 | Pristash et al. | |

(Continued)

FOREIGN PATENT DOCUMENTS

DE 295 16 860 U1 3/1996

(Continued)

*Primary Examiner*—Sharon E Payne
(74) *Attorney, Agent, or Firm*—McDermott Will & Emery LLP

(57) ABSTRACT

A lighting apparatus (10) is described for incorporation into a tiled wall, panel, ceiling, floor or similar structure (38,40). The apparatus comprises: a reflector unit (12, 14) that has at least one reflective surface (24, 26) for location behind the surface of the structure and an external light-transmissive face (14) for location generally flush with the surface of the structure; and means (28) for coupling an end of a fiber-optic cable (32) having a multiplicity of optical fibers (34) to the reflector unit behind the surface of the structure so that light projecting from the ends of the fibers enters the reflector unit and is reflected by the reflective surface(s) so as to provide substantially uniform illumination across the light-transmissive face. The reflector unit is formed with an external flange (20) generally parallel to the light-transmissive face. This facilitates positive fixing of the apparatus to the substrate of the wall or ceiling, for example using tile cement, and enables repositioning of the apparatus and surrounding tiles until the cement is dry.

1 Claim, 7 Drawing Sheets

U.S. PATENT DOCUMENTS

| | | | | |
|---|---|---|---|---|
| 5,426,573 | A * | 6/1995 | Jenkins | 362/154 |
| 6,217,189 | B1 * | 4/2001 | Nassim | 362/147 |
| 6,438,912 | B1 * | 8/2002 | Avent | 52/207 |

FOREIGN PATENT DOCUMENTS

| | | | |
|---|---|---|---|
| FR | 2 718 514 | | 10/1995 |
| GB | 2 101 289 | A | 9/2001 |
| JP | SHO 51-148933 | | 12/1976 |
| JP | 56024305 | A * | 3/1981 |
| JP | 62-190203 | | 12/1987 |
| JP | SHO 63-63457 | | 5/1988 |
| JP | 07-301712 | | 11/1995 |
| JP | 08-211837 | | 8/1996 |
| JP | 8-211837 | * | 8/1996 |
| JP | 11-142652 | | 9/1997 |
| WO | WO 01/71122 | A1 | 9/2001 |

* cited by examiner

FIG. 2
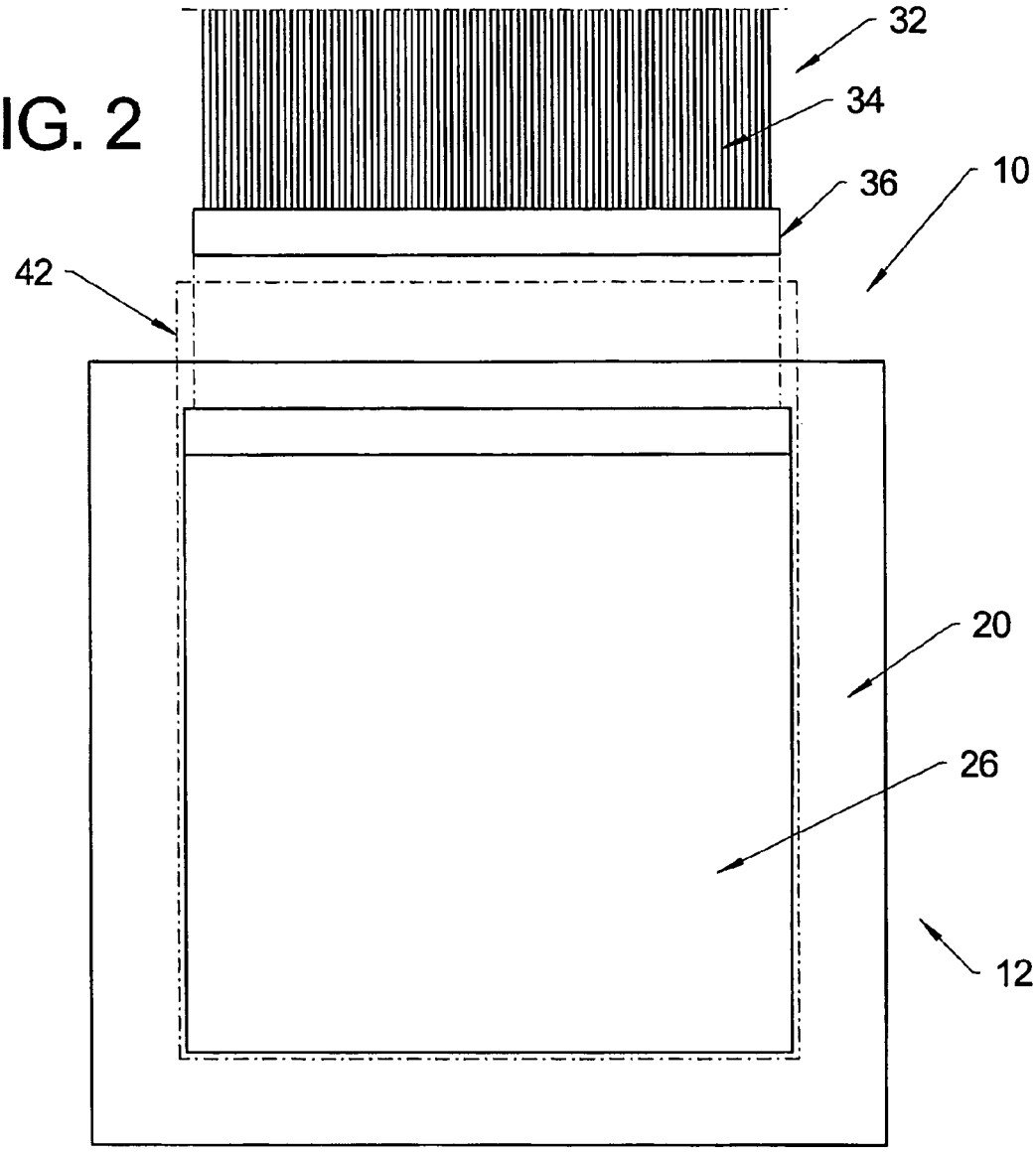
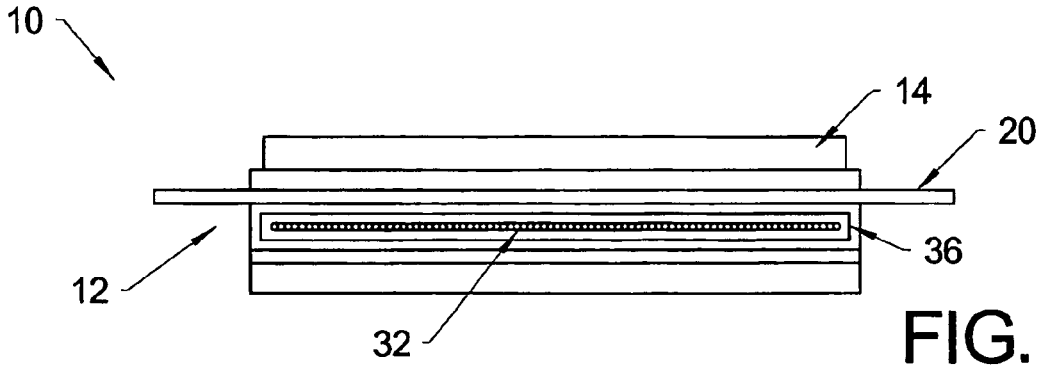
FIG. 3

FIG. 7
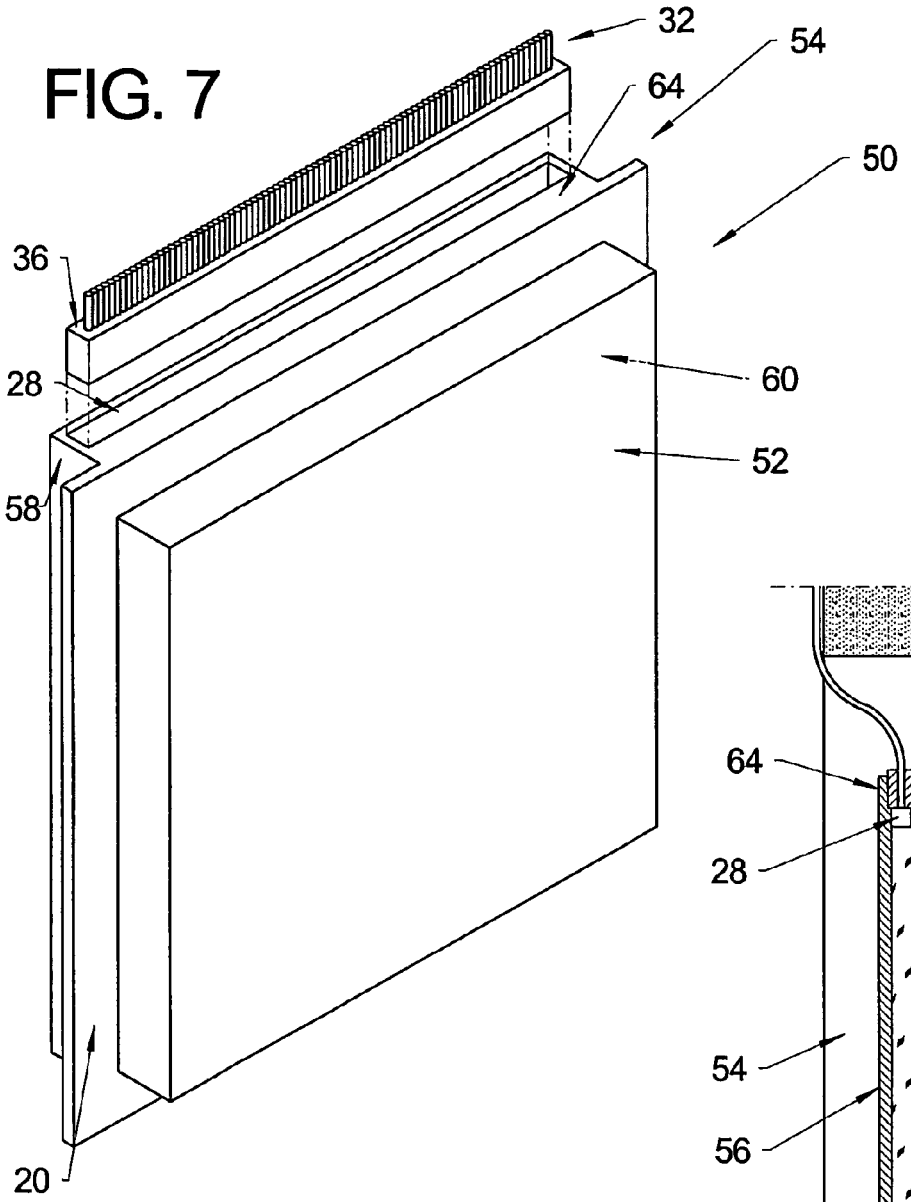
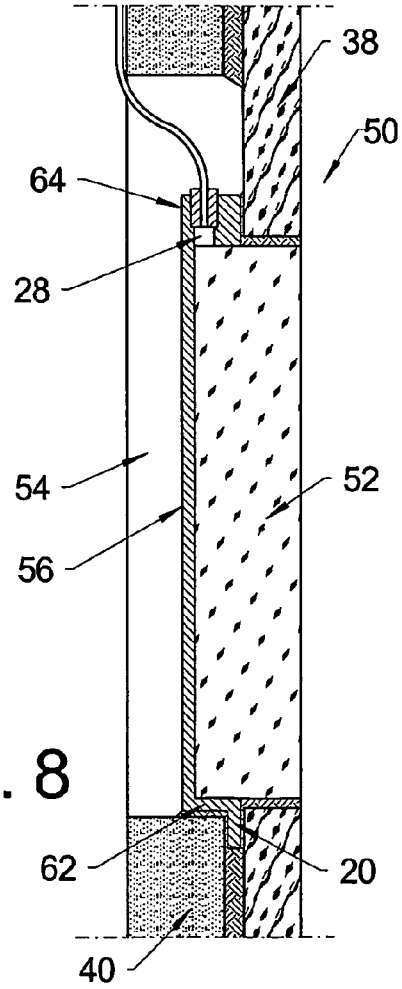
FIG. 8

FIG. 12B
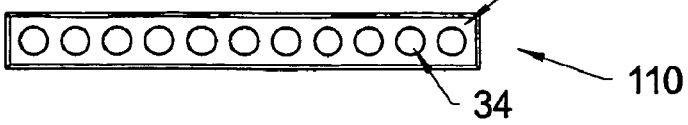
FIG. 12A
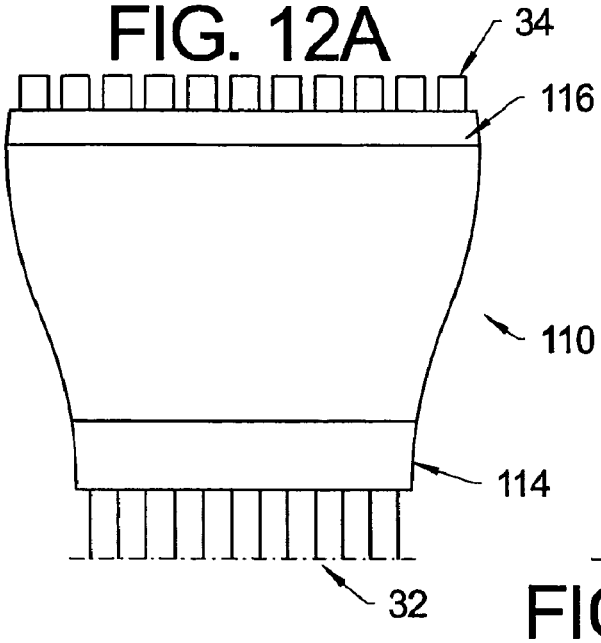
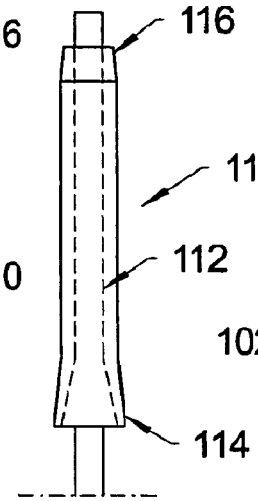
FIG. 13
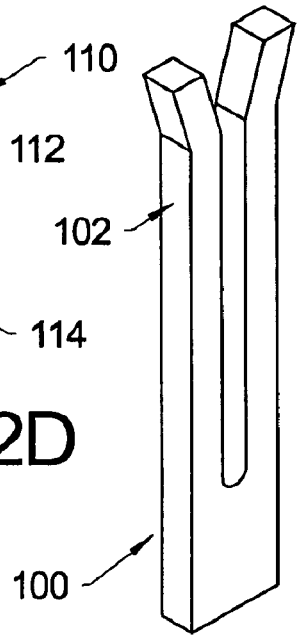
FIG. 12D
FIG. 12C
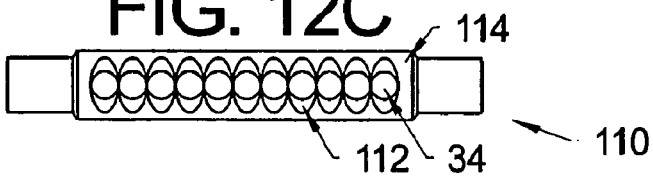
FIG. 12E
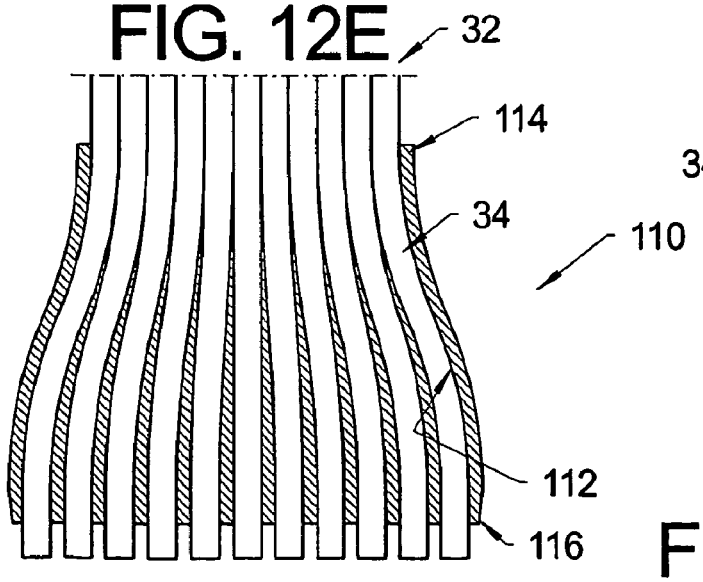
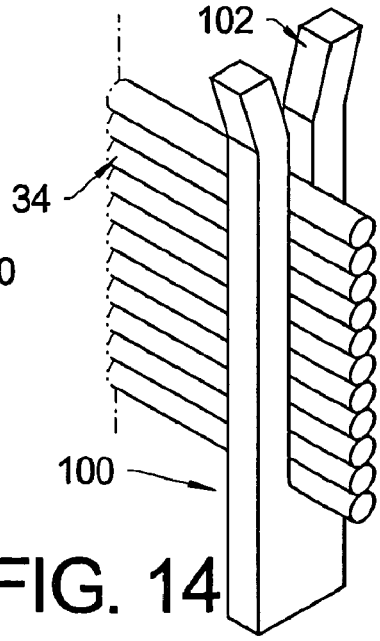
FIG. 14

LIGHTING APPARATUS FOR INCORPORATION INTO WALLS, PANELS, CEILINGS, FLOORS OR SIMILAR STRUCTURES

This application is a U.S. national filing under 35 U.S.C. 371 and claims priority from PCT/GB02/04229, filed Sep. 17, 2002, and from British Application No. 0200839.9 filed Jan. 15, 2002 and British Application No. 0122397.3 filed Sep. 17, 2001.

DESCRIPTION

This invention relates to lighting apparatus for incorporation into walls, panels, ceilings, floors or similar structures. The invention was originally conceived to provide a decorative lighting effect in a tiled wall or ceiling, but it may be applied to other structures, and it may be used for other purposes, for example direction indication.

Lighting apparatus typically uses an electric light bulb or tube as a source of light, and there is a need to be able to replace the light bulb easily when it blows. In the case where the lighting apparatus is employed in a wet or damp environment (such as outdoors, in the wall or bottom of a swimming pool, or in the wall or ceiling of a shower cubicle), there is a need to insulate any high-voltage electrical supply for the apparatus from the wet or damp environment. To deal with these needs, it is known to use a fibre-optic cable to transmit light from the light source (which may be in a dry and easily-accessible location) to the light outlet. This invention employs such a technique, and the invention relates more particularly to a lighting apparatus for incorporation into a wall, panel, ceiling, floor or similar structure, the apparatus comprising: a reflector unit that has at least one reflective surface for location behind the surface of the structure and an external light-transmissive face for location generally flush with the surface of the structure; and means for coupling an end of a fiber-optic cable having a multiplicity of optical fibres to the reflector unit behind the surface of the structure so that light projecting from the ends of the fibres enters the reflector unit and is reflected by the reflective surface(s) so as to provide substantially uniform illumination across the light-transmissive face.

Such an apparatus is known and takes the form of an illuminated block intended to be incorporated into a block-paved path laid on a sand or mortar base. The thickness of the illuminated block and the other non-illuminated blocks might typically be 3½" (90 mm). The fibre-optic cable, which might typically have an external diameter of about ¾" (20 mm), enters the centre of one side of the illuminated block. To allow an adjacent one of the non-illuminated blocks to butt up against that side of the illuminated block, the adjacent block has a notched underside. The fibre-optic cable is curved downwardly in the notch, and then passes under other blocks of the path by being embedded in the sand or mortar base.

A first aspect of the invention is concerned with providing an apparatus that (a) can be incorporated into a block arrangement, but that does not require an adjacent block to be notched to receive the fibre-optic cable, and (b) can readily be used with thinner blocks than mentioned above, for example floor, wall or ceiling tiles having a thickness of perhaps ¼ to ½" (6 to 13 mm).

The apparatus of the first aspect of the invention is characterised in that the coupling means is arranged to locate the ends of the fibres so that their overall cross-section is as a ribbon, for example in a single row or relatively few rows. In the case of, for example, a tiled wall, because of the thinness of the ribbon cross-section, the optical fibres can be embedded unnoticeably in the adhesive by which an adjacent tile is affixed to the wall. Also, in the case of, for example, a tiled or untiled plasterboard wall having restricted space behind the plasterboard, the ribbon cable can be more readily fed through the restricted space. Furthermore, the ribbon configuration can be used to facilitate obtaining uniform illumination across the light-transmissive face of the apparatus, because the light enters the reflector unit as a band, rather than a spot, of light.

Preferably, the depth of the reflector unit behind the surface of the structure is substantially less than (for example less than one half of and more preferably less than one third of) any dimension of the light-transmissive face across the face. More preferably, the depth of the reflector unit is such that when fitted into a plasterboard or MDF panel having a thickness of, say, ½" (12 mm), it does not protrude behind the rear face of the panel. This enables the apparatus to be used in, for example, a plasterboard wall without the need to excavate whatever may be behind the plasterboard, such as another sheet of plasterboard in the case of an internal wall, or a layer of bricks or blocks in the case of an external wall.

In one embodiment, the reflector unit comprises a solid block of light-transmissive material, one surface of the block providing the light-transmissive face, at least one other surface of the block providing the reflective surface(s) by internal reflection within the block, and a further surface of the block being arranged to receive light from the ends of the optical fibres.

In the known apparatus described above for providing an illuminated block in a block-paved path, the apparatus simply rests on the sand or mortar base, and non-illuminated blocks butt up against it on all four sides. However, if lighting apparatus of this generally type is to be used in a tiled wall or ceiling, it is necessary to provide more positive fixing of the apparatus to the substrate of the wall or ceiling, and a second aspect of the invention is concerned with this.

The lighting apparatus of the second aspect of the invention is characterised in that the reflector unit is formed with an external flange generally parallel to the light-transmissive face.

The flange may lie behind the light-transmissive face and preferably be relatively thin. In this case, when the apparatus is to be affixed to, for example, a plasterboard wall, a hole can be cut in the plasterboard to receive the apparatus, the rear of the flange can be cemented to the plasterboard around the hole, and other tiles can be laid over the flange and around the light-transmissive face.

In one embodiment, the reflector unit may comprise: a hollow box, the box having at least one wall providing the reflective surface(s), an opening arranged to receive light from the optical fibres, and an open side; and a light-transmissive plate closing the open side of the box and providing the light-transmissive face. In this case, the apparatus preferably further includes a light-transmissive element extending across and sealing the opening, and the light-transmissive plate preferably seals the open side of the box. Moisture, debris and insects can therefore be kept out of the box. In this case, the flange may provided by a marginal edge of the light-transmissive plate extending beyond the sides of the box. When the apparatus is to be affixed to, for example, a plasterboard wall, a hole can be cut in the plasterboard to receive the reflector box, the rear of the flange can be cemented to the plasterboard around the hole, and other tiles can be laid around and butt up against the edges of the light-transmissive plate.

A mounting frame may also be provided having an opening sized and shaped to receive the outline of the reflector unit behind the flange. The frame is preferably relatively thin and can be sandwiched and cemented between the substrate of the wall or ceiling. The frame enables the hole that is cut in the substrate to receive the apparatus to be cut oversize to allow fine positioning of the apparatus and/or to be cut roughly, and yet enables to apparatus to be firmly secured to the substrate.

In accordance with a third aspect of the invention, there is provided a wall, panel, ceiling, floor or similar structure having: a substrate; a lighting apparatus according to the first or second aspect of the invention embedded in the substrate; an arrangement of tiles affixed to the substrate and surrounding and generally flush with the light-transmissive face; a fibre-optic cable having a multiplicity of optical fibres coupled at one end to the coupling means; and a light source for shining light into the other end of the fibre-optic cable.

In accordance with a fourth aspect of the invention, there is provided a panel having: a hole therethrough; a lighting apparatus according to the second aspect of the invention mounted behind the panel and having the light-transmissive face filling the hole, the front face of the flange or frame being secured to the rear of the panel around the hole; a fibre-optic cable having a multiplicity of optical fibres coupled at one end to the coupling means; and a light source for shining light into the other end of the fibre-optic cable.

Specific embodiments of the present invention will now be described, purely by way of example, with reference to the accompanying drawings, in which:

FIG. 2 is a rear view of the apparatus of FIG. 1;

FIG. 3 is a plan view of the apparatus of FIG. 1;

FIG. 7 is an isometric view of a second embodiment of lighting apparatus;

FIG. 8 is a sectioned side view of the apparatus of FIG. 7 incorporated into a tiled wall having a plasterboard substrate;

Figure 11A:
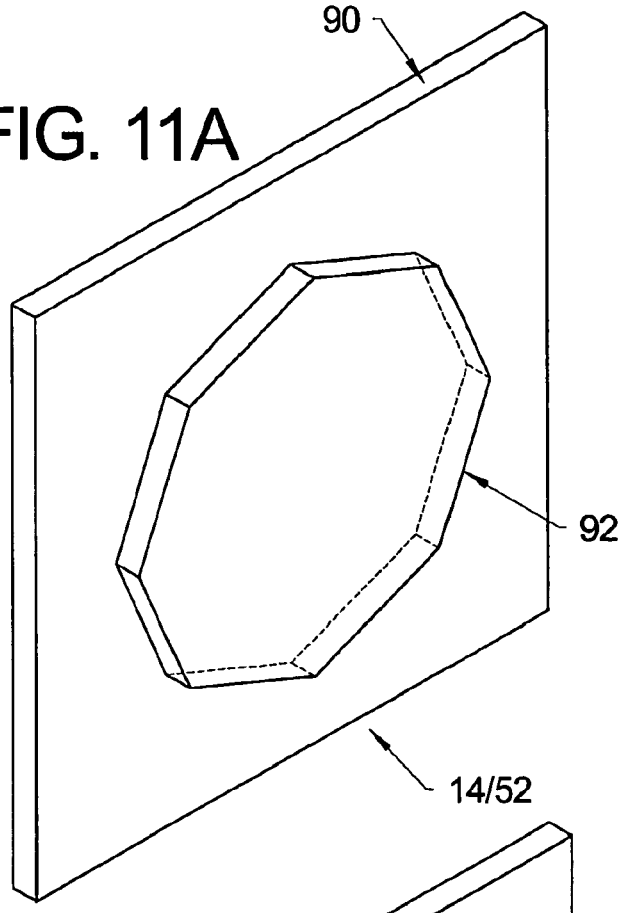
Figure 11B:
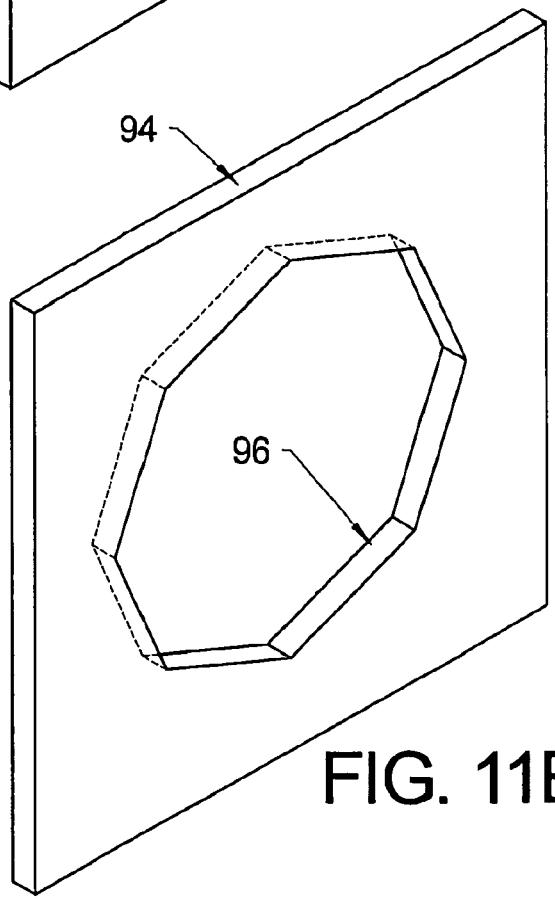

FIGS. 11A-B are isometric views of the elements of a modified light transmissive plate;

FIGS. 12A-E are a plan view, a view of one end, a view of the other end, a side view and a sectioned plan view of a modified plug for connecting the fibre-optic cable to the lighting apparatus;

FIG. 13 is an isometric view of jig to facilitate insertion of the optical fibres into the plug; and FIG. 14 is similar to FIG. 13, but showing the jig in use.

Referring to FIGS. 1 to 4, the first embodiment of lighting apparatus 10 comprises a reflector box 12 and a light-transmissive front plate 14. The reflector box 12 is moulded from plastics material, but may be made in any other suitable manner from any other suitable material. In the example shown, the front plate 14 is square and is made of clear or coloured frosted glass or plastics material that has a relatively high transmittance to at least some colours of visible light, but which obscures any detail being seen through the plate 14.

The reflector box 12 has: a square open front 16 surrounded by a rabbeted lip 18; a planar external flange 20 behind the lip 18 and surrounding the open front 16; a top wall 22 and a pair of side walls 24 behind the flange 20; and a rear wall 26 that extends between the rear edges of the side walls 24 and from the rear edge of the top wall 22 to the lower portion of the rabbeted lip 18. The rear edges of the side walls 24 are curved so that the rear wall 26 is part-cylindrical and concave, as seen from inside the box 12. The depth D of the box 12 behind the rear face of the flange 20 is preferably about ½" (12 to 13 mm). The top wall 22 is formed along almost its entire length with a shouldered slot 28, and the bottom of the slot 28 is covered by a strip 30 of clear glass or plastics material cemented into a complementary recess in the lower face of the top wall 22.

The light-transmissive front plate 14 is dimensioned so that it is a snug fit in the rabbet of the lip 18, and it is cemented in place so that the plate 14 and the strip 30 seal the box 12 against the ingress of water, condensation, insects and other material.

The inner surfaces of the walls 22,24,26 of the box 12 are highly reflective to visible light, for example by being coated with a shiny metallic film, lined with a shiny metallic foil or by being white. In use, light is introduced into the box from a light source (not shown) via a fibre-optic cable 32. The light source is installed in an easily accessible and dry location. The light source may produce white light, or light of any desired colour, and it may be arranged to change the colour of light periodically. At least at the box end of the cable 32, the optical fibres 34 of the cable are arranged side-by-side in a single row, or relatively few rows, as a ribbon. The ends of the optical fibres 34 are secured into a male connector plug 36 that is fitted into the slot 28 in the top wall 22 of the reflector box 12 so that the ends of the optical fibres 34 point in a direction parallel to the light-transmissive plate 14. The plug 36 may be held in the slot 28 by a friction fit, assisted possibly by a sealing ring (not shown) and/or by a latching mechanism (not shown). The light that is shone into the box 12 reflects off the walls 22,24,26 of the box 12 and may partially reflect off the inner surface of the plate 14, and is transmitted through the plate 14 so that from the outside the plate is illuminated with a generally uniform light distribution.

The apparatus of FIGS. 1 to 4 is intended to be installed amongst an array of tiles 38 cemented to a plasterboard wall 40. During installation, a hole (as shown in dash-dot lines 42 in FIG. 2) is cut in the plasterboard wall 40, and the fibre-optic cable 32 is fed behind the wall 40 to the hole 42. The plug 36 is fitted into the slot 28, and the box 12 is fitted into the hole 42 and held roughly in position by cement 44 between the wall 40 and the rear faces of the side and lower portions of the flange 20. The surrounding tiles 38 are then cemented in place with their edges adjacent the box 12 overlapping the flange 20, and with the face of the plate 14 flush with the faces of the surrounding tiles 38. The positions of the box 12 and tiles 38 are finely adjusted before the cement sets.

Figure 1:
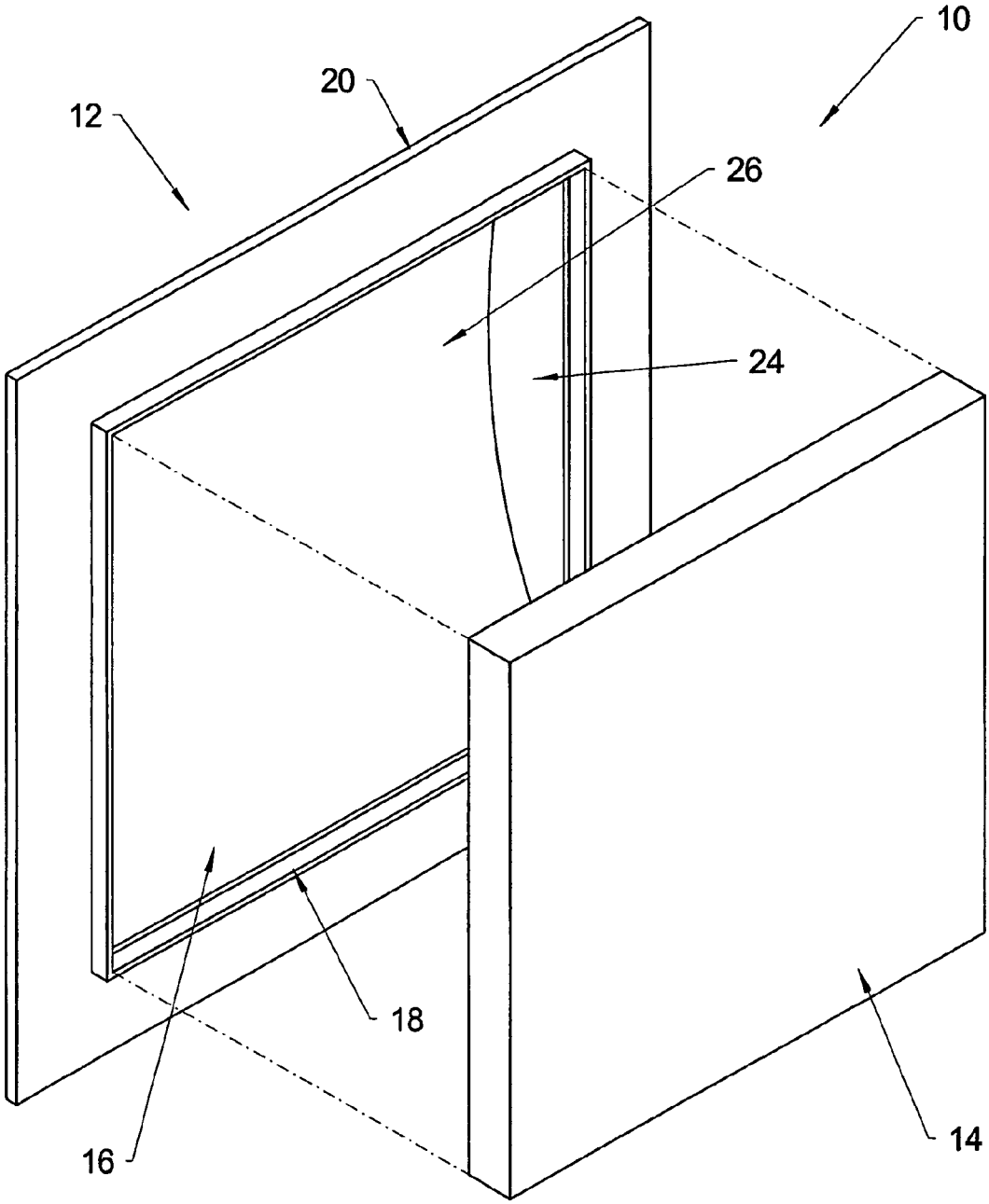
FIG. 1 is an exploded isometric view of a first embodiment of lighting apparatus.
Figure 4:
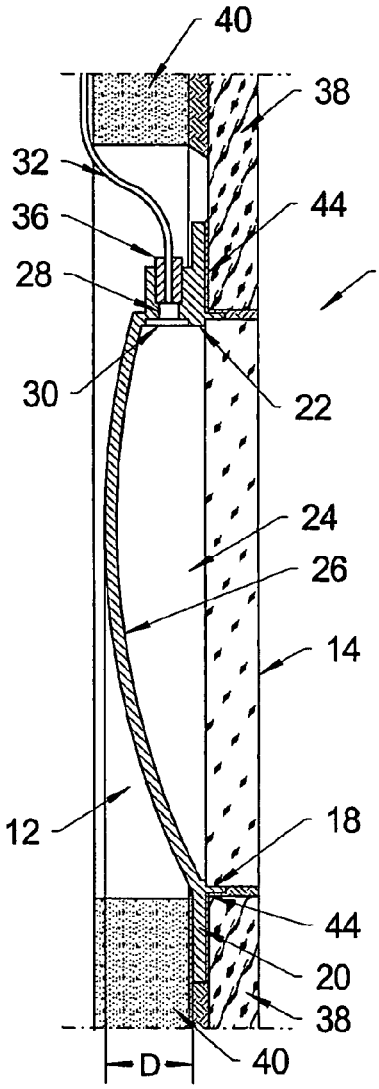
FIG. 4 is a sectioned side view of the apparatus of FIG. 1 incorporated into a tiled wall having a plasterboard substrate.
Figure 5:
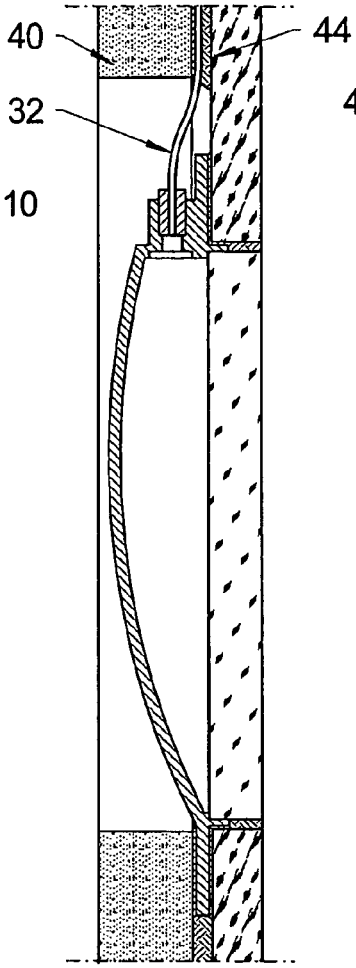
FIG. 5 is similar to FIG. 4, but showing a modified path for the fibre-optic cable.

FIG. 5 shows a modification to the above, in the case where it is not possible to feed the fibre-optic cable 32 behind the wall 40. In this case, the fibre-optic cable 32, in its ribbon form and with a protective sleeve or other covering, is embedded in the cement 44 that is used to hold the tiles 38 in place.

Figure 6:
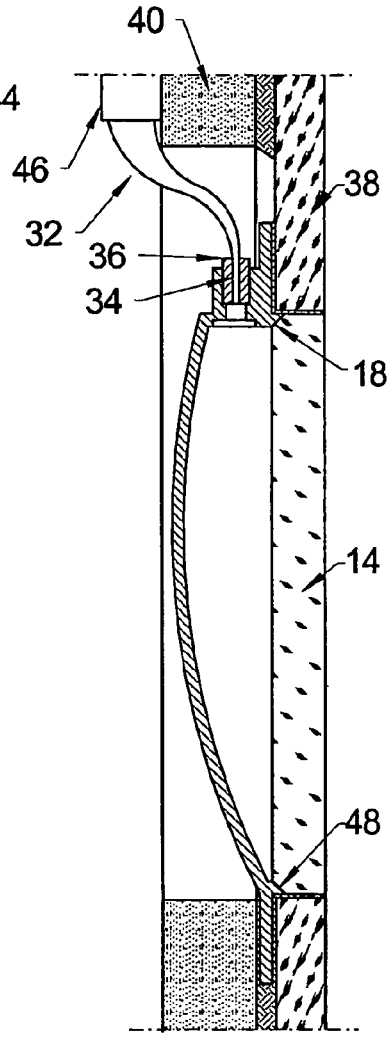
FIG. 6 is similar to FIG. 4, but showing another modified path for the fibre-optic cable and a modified light transmissive plate.

FIG. 6 shows a modification to the above, in the case where there is more room to feed the fibre-optic cable 32 behind the wall 40. In this case, for most of their run, the optical fibres 34 of the cable are bound in a twisted formation in a circular cross-section sheath 46 that enables the cable 32 to be curved more easily in various directions. The sheath 46 terminates shortly before the ends of the optical fibres 34, and the fibres 34 are splayed out into the ribbon form and held in the plug 36. In order to prepare such an end of the cable 32, the sheath 46 is cut back the required amount. The fibres 34 are then inserted side-by-side into an elongate U-shaped jig 100, as shown in FIGS. 13 and 14, resembling a hair-grip with a spacing between the tines 102 of the jig 102 being only slightly larger than the diameter of each fibre 34. The ends of the fibres 34 are then inserted into the plug 36 and glued in place, for example with cyanoacrylate (superglue). Once the glue is set, the jig 100 is removed, and the ends of the fibres 34 are trimmed flush with the plug 36. The plug 36 may alternatively be made in two portions that are fastened together and hold the fibres in place due to the fastening pressure.

FIG. 6 also shows a modification in which the lip 18 is bevelled, rather than rabbeted, and a complementary bevel 48 is provided on the inner edges of the light-transmissive plate 14. This enables a smaller a gap between the plate 14 and the surrounding tiles 38.

The second embodiment of lighting apparatus 50 will now be described with reference to FIGS. 7 and 8. The second embodiment is similar to the first embodiment except in the following respects.

Instead of employing a hollow box 12 closed by a light-transmissive plate 14, the apparatus 50 has a thicker block 52 of light-transmissive material that is bonded to a housing 54 having a rear wall 56 covering the rear face of the block 52, side walls 58,60 and a bottom wall 62 partially covering the side and bottom edges of the block 52, and a thicker top wall 64 partially covering the top edge of the block 52. The front edges of the side and bottom walls 58,60,62 are flanged and provide, in combination with the front edge of the top wall 64, a planar external flange face 20 encircling the edges of the block 52. The top wall 64 is formed with the shouldered slot 28 to receive the plug 36 at the end of the fibre-optic cable 32. Before being bonded in the housing 54, the rear face and the edges of the block 52 are silvered, painted or coated white, or otherwise treated so that they are totally reflective.

The apparatus 50 of FIGS. 7 and 8 is installed in much the same way as the apparatus 10 of FIGS. 1 to 6, with the rear surfaces of the side and bottom portions of the flange 20 being cemented to the plasterboard 40, and with the surrounding tiles 38 overlapping the front surface of the flange 20 and butting up against the edges of the light transmissive block 52.

The third embodiment of lighting apparatus 70 will now be described with reference to FIGS. 9 and 10. The third embodiment is similar to the first embodiment except in the following respects.

Figure 9:
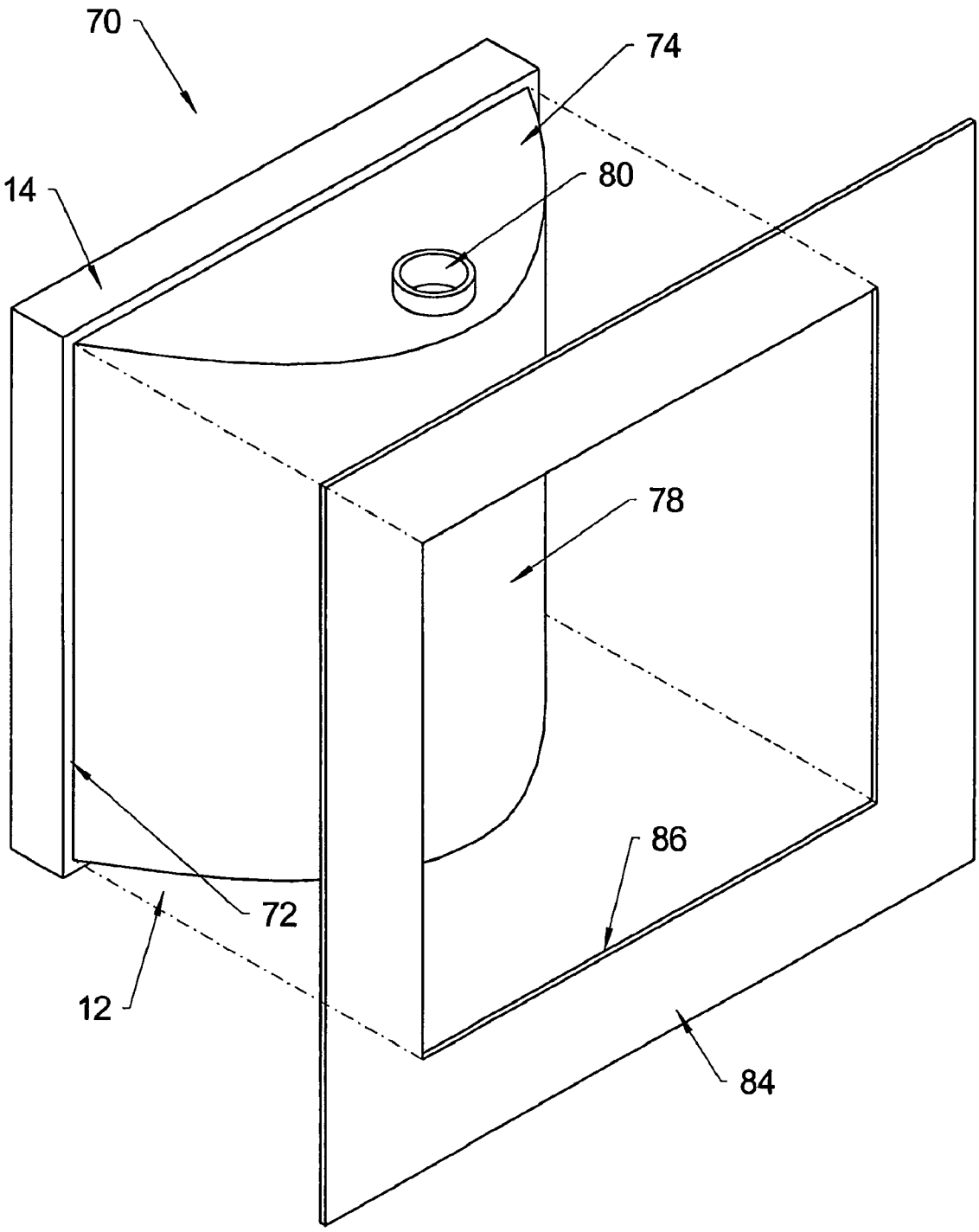
FIG. 9 is an exploded isometric rear view of a third embodiment of lighting apparatus.
Figure 10:
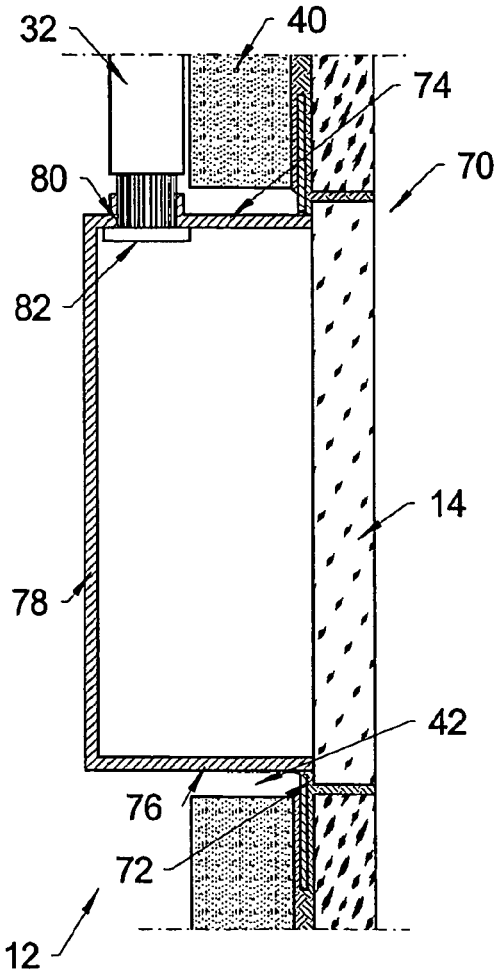
FIG. 10 is a sectioned side view of the apparatus of FIG. 9 incorporated into a tiled wall having a plasterboard substrate.

In FIGS. 9 and 10, the light-transmissive plate 14 is bonded to the front edge of the reflector box 12, so that the marginal edges of the plate 14 project beyond the outline of the reflector box 12 to form a flange 72. The reflector box 12 has upper and lower walls 74,76 having arcuate rear edges, and the rear wall 78 of the reflector box 12 is part-cylindrical, following the lines of the rear edges of the upper and lower walls 74,76. The inner surfaces of the upper, lower and rear walls 74,76,78 are reflective. The upper wall 74 is formed with an opening 80 to receive the end of the circular cross-section optical-fibre cable, and the opening is sealed by a disc 82 of clear glass or plastics material. The apparatus 70 also includes a mounting frame 84 formed from a rectangle of thin sheet material, which may be meshed, having a central rectangular hole 86 that is a snug fit around the outline of the reflector box 12 immediately behind the flange 72.

During installation of the apparatus 70, a hole 42 is cut in the plasterboard wall 40 that is larger than the hole 86 in the frame 84 but smaller than the outline of the frame 84. The frame 84 is fitted to the reflector box 12, and the rear of the reflector box is fitted into the hole 42 with the end of the fibre-optic cable 32 fitted into the opening 80. The frame 84 is held roughly in position against the wall 40, and the box 12 is held roughly in position in the frame 84, by cement 44. The surrounding tiles 38 are then cemented in place with their edges adjacent the box 12 overlapping the frame 84, and with the front face of the plate 14 flush with the faces of the surrounding tiles 38. The positions of the box 12 (and frame 84) and tiles 38 are finely adjusted before the cement sets.

Many modifications and developments may be made to the embodiments of the invention described above. For example, the light-transmissive plate 14 or block 52 need not be square or rectangular, but may be a more complex regular or irregular shape, in which case the reflector box 12 or housing 54 may be shaped complementarily, and the plug 36 may also be shaped to follow the outline of part of the shape, with the ends of the optical fibres 34 being trimmed accordingly. Alternatively, in order to obtain a similar effect, and as shown in FIG. 11A, the light-transmissive plate 14 or block 52 may be formed in two parts 90, 92 that are UV-bonded together. One part 90 has a square or rectangular shape to fit the reflector box 12 or housing 54. The other, front, part 92 is cut to the required visible shape (which is shown as an octagon in the FIG. 11A but may be any desired shape). One of the tiles 94 of the type that will surround the apparatus is cut, for example using a water jet cutter, with a hole 96 to match the shape of the shaped part 92, as shown in FIG. 11B. During installation, the tile 94 is cemented to the part 90 so that the part 92 fills the hole 96, and so that in use the part 92 is illuminated, but the tile 94 is not, due to its opaqueness. Alternatively, the part 92 may be of one colour, and the tile 94 may be light-transmissive and of a different colour.

In the embodiments shown in FIGS. 1 to 8, it may be desirable that the ends of the optical fibres 34 projecting into the lighting apparatus 10,50 are spaced apart from each other, rather than being contiguous. In order to achieve this, a modified plug 110, as shown in FIGS. 12A to 12E may be employed. The plug 110 has a linear array of channels 112 extending through it. At one end 114 of the plug 110, the channels are contiguous, but they diverge through the plug 110, so that, at the opposite end 116 of the plug 110, they are spaced apart. At said one end 114, the channels 112 are widened in the thickness direction of the plug so as to facilitate insertion of the optical fibres 34 into the plug 110. Again, in order to fit the fibres 34 into the plug 110, the jig 100 of FIG. 13 may be used to arrange the fibres 34 into a single contiguous row, as shown in FIG. 14. Then, with the fibres 34 held in the jig 100, the ends of the fibres 34 are inserted into the widened portions of the channels 112 at the end 114 of the plug 110 and pushed through the channels 112, so that they protrude from the other end 116 of the plug 110 in a spaced-apart configuration. Glue may be used to hold the fibres 34 in position. The jig 100 is removed, and the projecting ends of the fibres 34 may be trimmed.

Although the examples of the invention have been described in the context of a tiled, plasterboard wall, the invention is also applicable to walls having other substrates, and to ceilings, floors, paths, prefabricated panels (for example for shower cubicles), etc. The invention can be used with a particularly pleasing effect in the walls or bottom of a swimming pool. In the case where the apparatus is used with a panel, the front face of the flange 20 or frame 84 may be glued or otherwise fastened to the rear face of the panel.

Whilst it may be desirable that the outer face of the light-transmissive plate 14 or block 52 is perfectly flush with the surrounding tiles, in some cases it may be desirable that the outer face of the light-transmissive plate 14 or block 52 is recessed slightly behind, or projects slightly from, the surrounding tiles, and the term "generally flush" used in this specification is intended to encompass such variations.

It should be noted that the examples of the invention have been described above purely by way of example and that many other modifications and developments may be made thereto within the scope of the present invention.

The invention claimed is:

1. A lighting apparatus (10; 50; 70) for incorporation into a wall, panel, ceiling, floor or similar structure (38, 40), the apparatus comprising:

a reflector unit (12,14; 52,54) that has at least one reflective surface (24,26) for location behind the surface of the structure and an external light-transmissive face (14;52) for location generally flush with the surface of the structure;

means (28;80) for coupling an end of a fibre-optic cable (32) having a multiplicity of optical fibres (34) to the reflector unit behind the surface of the structure so that light projecting from the ends of the fibres enters the reflector unit and is reflected by the reflective surface(s) so as to provide substantially uniform illumination across the light-transmissive face;

the reflector unit is formed with an external flange (20) generally parallel to the light-transmissive face;

the reflector unit (12,14) comprises: a hollow box (12), the box having at least one wall (24,26) providing the reflective surface(s), an opening (28) arranged to receive light from the optical fibres, and an open side (16); and a unitary light-transmissive plate (14) closing the open side of the box and providing the light-transmissive face; and, the light-transmissive plate having first and second layers of different shapes, the first and second layers adjoining each other.

* * * * *